US006779988B2

(12) United States Patent
Chen

(10) Patent No.: US 6,779,988 B2
(45) Date of Patent: Aug. 24, 2004

(54) STRUCTURE OF A BASE FOR A MINI AIR COMPRESSOR

(76) Inventor: Chih-Ming Chen, PO Box 82-144, Taipei (TW)

( * ) Notice: Subject to any disclaimer, the term of this patent is extended or adjusted under 35 U.S.C. 154(b) by 50 days.

(21) Appl. No.: 10/265,116

(22) Filed: Oct. 7, 2002

(65) Prior Publication Data

US 2004/0067145 A1 Apr. 8, 2004

(51) Int. Cl.[7] ..... F04B 17/06; F16M 1/04
(52) U.S. Cl. ..... 417/363; 248/638
(58) Field of Search ..... 417/363, 234; 248/638, 678

(56) References Cited

U.S. PATENT DOCUMENTS 2,454,538 A * 11/1948 Bazley et al. ..... 248/569
5,649,812 A * 7/1997 Schoenmeyr et al. ..... 417/363
6,011,336 A * 1/2000 Mathis et al. ..... 310/91

* cited by examiner

*Primary Examiner*—Charles G. Freay
(74) *Attorney, Agent, or Firm*—Leong C. Lei

(57) ABSTRACT

A base for an air compressor includes a convex H-shaped member made of resilient material and provided with four legs, the convex H-shaped member being provided with a plurality of internally threaded tubular member on a top thereof, each of the legs having an end provided with raised lines; and four rubber pads each adapted to engage with the end of each of the Legs, whereby the base will function as a shock absorber for the air compressor thereby absorbing the vibration force generated by the air compressor and therefore reducing the noise. Furthermore, the air compressor can operate more smoothly and steadily.

2 Claims, 5 Drawing Sheets

STRUCTURE OF A BASE FOR A MINI AIR COMPRESSOR

BACKGROUND OF THE INVENTION

1. Field of the Invention

This is invention is related to an improvement in the structure of a base for a mini air compressor.

2. Description of the Prior Art

Referring to FIG. 1, the conventional air compressor is mounted on a base A1 which is provided with a plurality of rubber pads A2 for reducing vibration generated by the air compressor in operation. Nevertheless, such a base cannot effectively prevent the air compression from moving in operation and absorbing the noise generated by the air compressor in operation.

Therefore, it is an object of the present invention to provide an improved base for an air compressor which can obviate and mitigate the above-mentioned drawbacks.

SUMMARY OF THE INVENTION

This invention is related to an improvement in the structure of a base for a mini air compressor.

It is the primary object of the present invention to provide an improved base for an air compressor which can function as a shock absorber for the air compressor.

It is another object of the present invention to provide an improved base for an air compressor which can absorb the vibration force generated by the air compressor thereby reducing the noise.

It is a further object of the present invention to provide an improved base for an air compressor which enables the air compressor to operate more smoothly and steadily.

According to a preferred embodiment of the present invention, a base for an air compressor includes a convex H-shaped member made of resilient material and provided with four legs, the convex H-shaped member being provided with a plurality of internally threaded tubular member on a top thereof, each of the legs having an end provided with raised lines; and four rubber pads each adapted to engage with the end of each of the legs.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
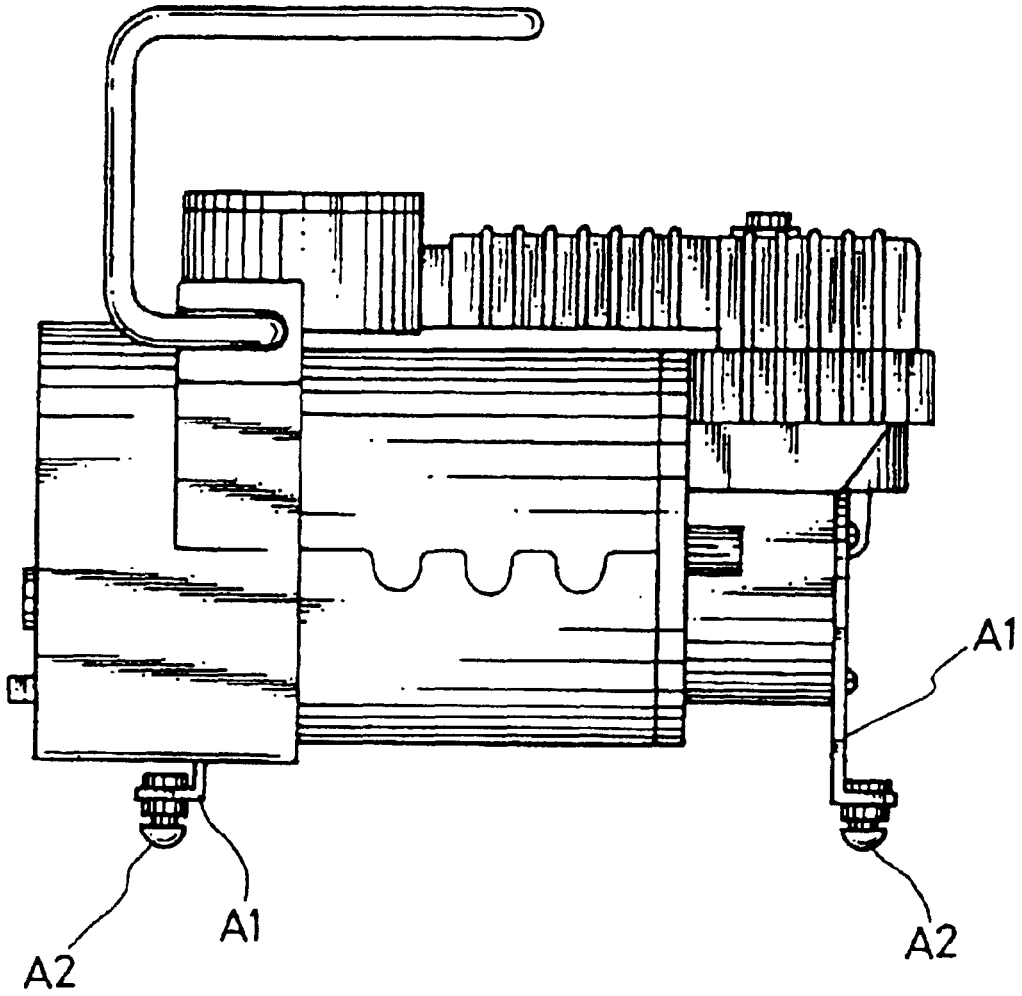
PRIOR ART FIG. 1
FIG. 1 illustrates a prior art air compressor.
Figure 2:
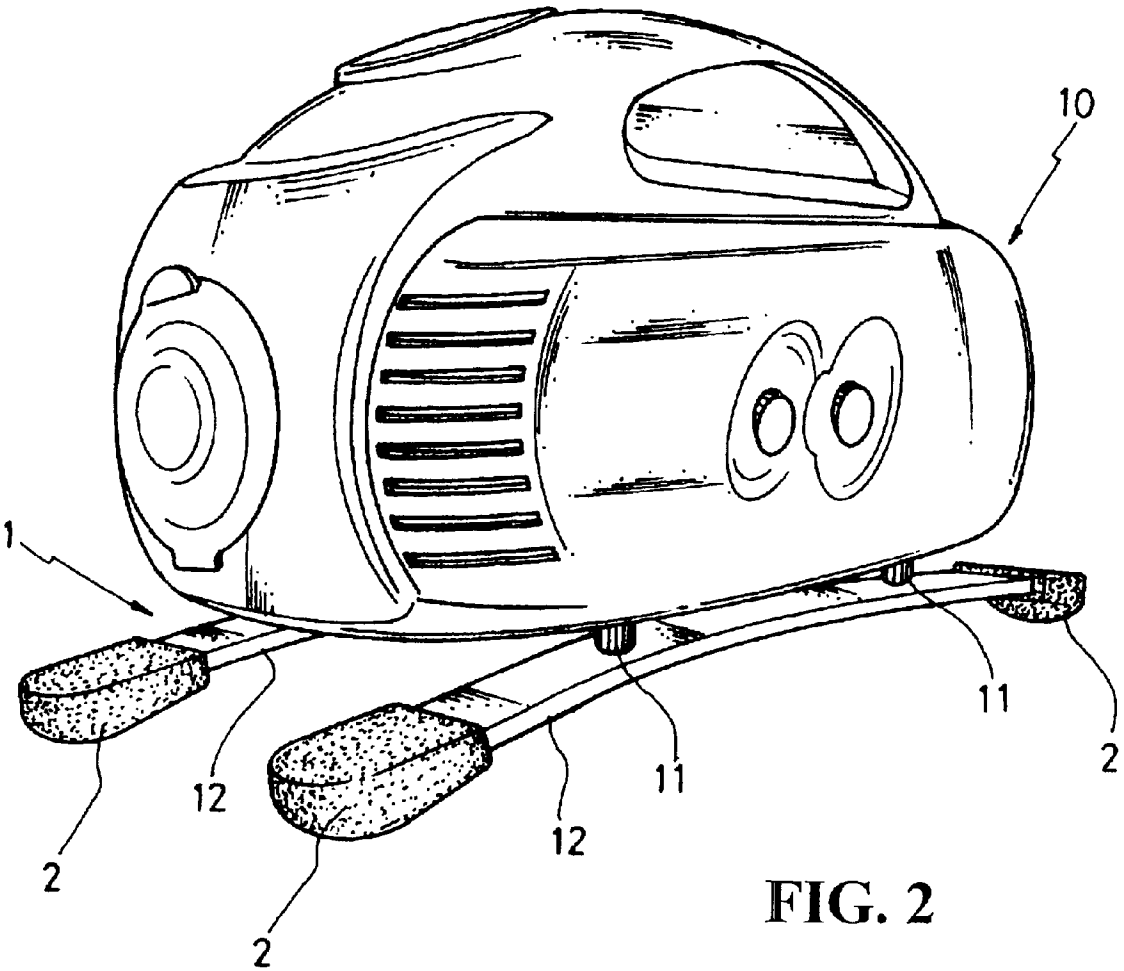
FIG. 2 is a perspective view of the present invention.
Figure 3:
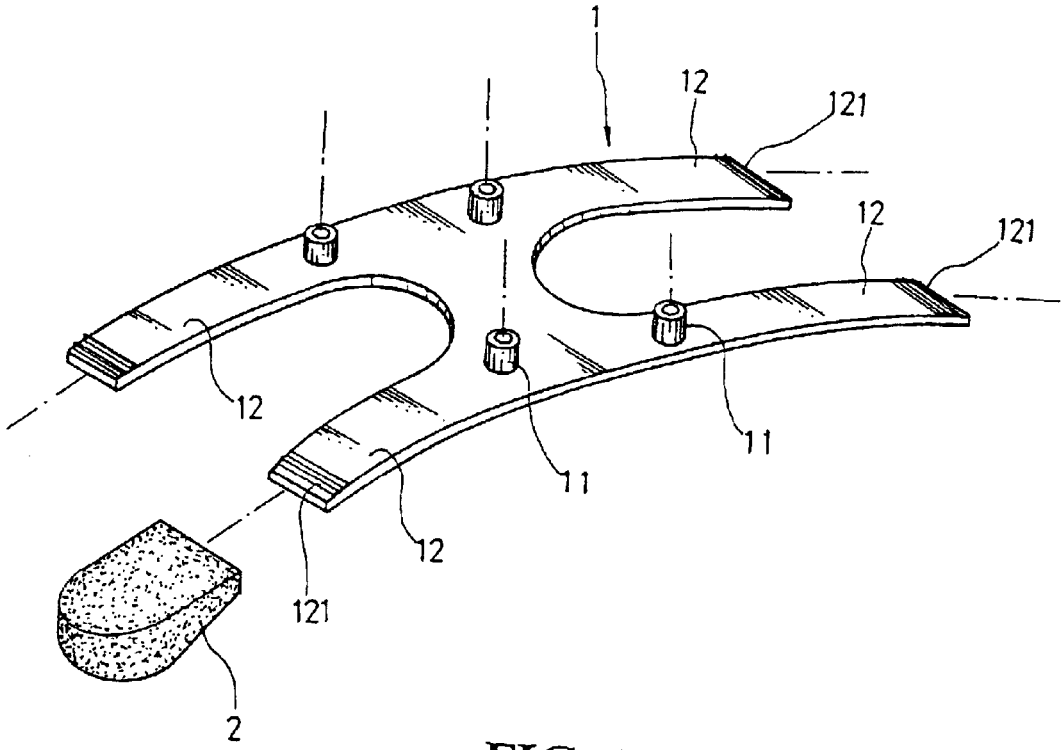
FIG. 3 is an exploded view of the present invention.
Figure 4:
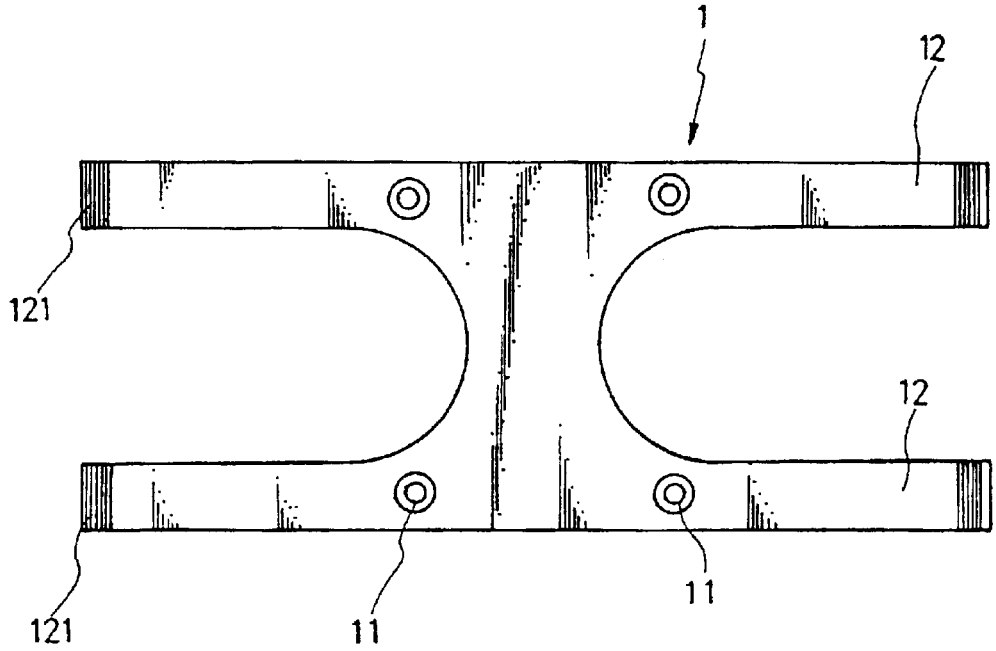
FIG. 4 is a top plan view of the present invention.

With reference to the drawings and in particular to FIGS. 2, 3 and 4 thereof, the base 1 for a mini air compressor according to the present invention is a convex H-shaped member made of resilient material. On the base 1 there are four internally threaded tubular members 11 so that the air compressor 10 can be firmly mounted on the base 1 by screws extending through the internally threaded tubular members 11.

Referring to FIGS. 3 and 4, the base 1 is formed with four legs 12 each adapted to be inserted into a rubber pad 2 which is used as a shock absorber for the base 1. The end of the leg 12 is formed with raised lines 121 for providing firm engagement between the leg 12 and the rubber pad 2.

Figure 5:
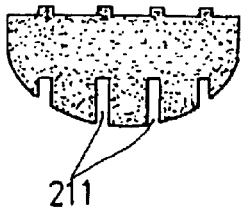
FIG. 5 is an end view of the rubber pad.
Figure 5A:
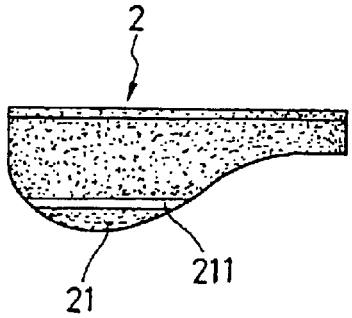
FIG. 5A is a side view of FIG. 5.

Referring to FIGS. 5 and 5A, the rubber pad 2 is formed with a protruded bottom 21 for contacting the floor. The bottom of the rubber pad 2 is formed with a plurality of channels 211 for providing the rubber pad 2 with a greater grapping force thereby enabling the base 1 to stand firmly on the floor.

Figure 6:
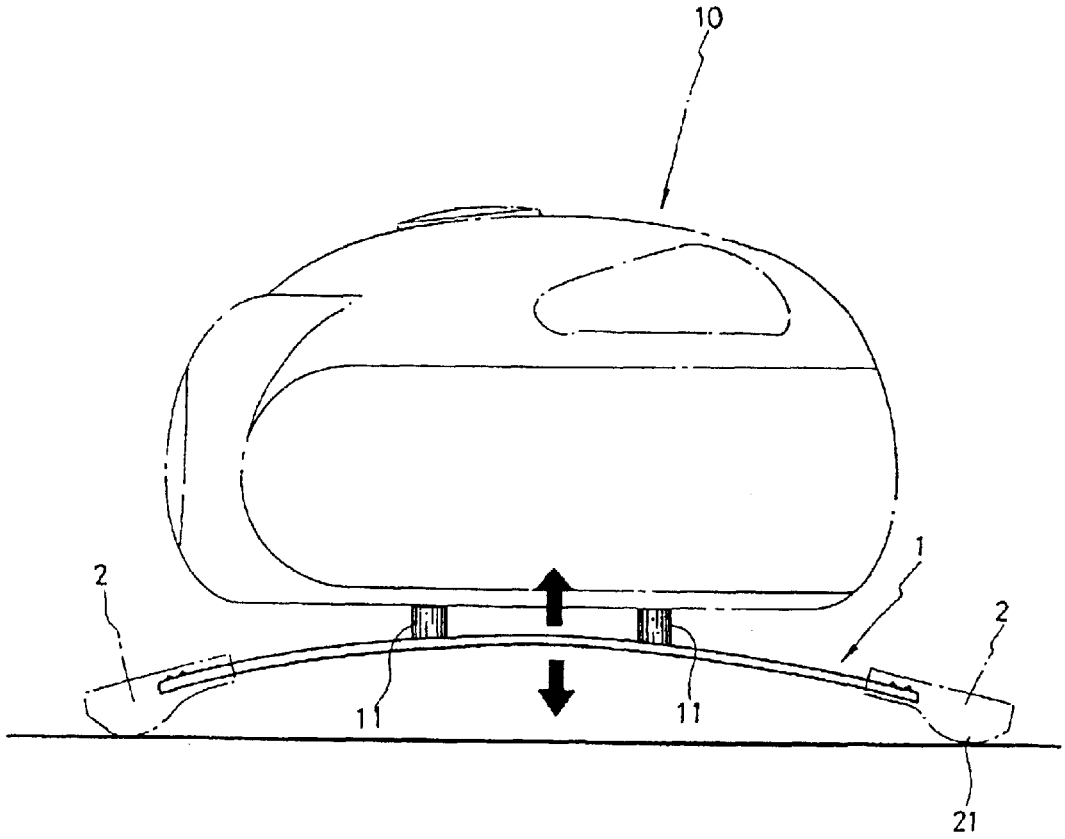
FIG. 6 illustrates the working principle of the present invention.

Looking now at FIG. 6, when in use, the air compressor 10 is mounted on the internally threaded tubular members 11 of the base 1. As the base 1 is a convex H-shaped member made of resilient material, the base 1 will function as a shock absorber for the air compressor 10 thereby absorbing the vibration force generated by the air compressor 10 and therefore reducing the noise. Furthermore, the air compressor 10 can operate more smoothly and steadily.

However, it should be understood that the convex H-shaped base 1 could be modified and replaced with an elongated rectangular member.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A base for an air compressor comprising:

a convex H-shaped member made of resilient material and provided with four legs, said convex H-shaped member being provided with a plurality of internally threaded tubular members on a top thereof, each of said legs having an end provided with raised lines; and four rubber pads each adapted to engage with the end of each of said legs.

2. The base for an air compressor as claimed in claim 1, wherein said of said rubber pads has a protruded bottom formed with a plurality of channels.

* * * * *